US008210447B2

(12) United States Patent
Cohen

(10) Patent No.: US 8,210,447 B2
(45) Date of Patent: Jul. 3, 2012

(54) COMBINATION BIRDBATH FOUNTAIN WITH WATER LEVEL MAINTAINING RESERVOIR

(75) Inventor: Richard Cohen, Ann Arbor, MI (US)

(73) Assignee: RSR Industries, Inc., Ann Arbor, MI (US)

( * ) Notice: Subject to any disclaimer, the term of this patent is extended or adjusted under 35 U.S.C. 154(b) by 1321 days.

(21) Appl. No.: 11/474,692

(22) Filed: Jun. 26, 2006

(65) Prior Publication Data

US 2007/0028846 A1 Feb. 8, 2007

Related U.S. Application Data

(60) Provisional application No. 60/694,370, filed on Jun. 27, 2005.

(51) Int. Cl.
*B05B 17/08* (2006.01)

(52) U.S. Cl. ..... 239/17; 239/20

(58) Field of Classification Search ..... 239/16, 239/17, 20, 22, 23, 28; 119/69.5, 72, 74
See application file for complete search history.

(56) References Cited

U.S. PATENT DOCUMENTS

| | | | | |
|---|---|---|---|---|
| 4,630,569 | A * | 12/1986 | Dieleman | 119/69.5 |
| 5,438,957 | A | 8/1995 | Shagoury | |
| 5,692,454 | A * | 12/1997 | Testa | 119/69.5 |
| 5,918,415 | A * | 7/1999 | Locke et al. | 47/79 |
| 6,179,218 | B1 | 1/2001 | Gates | |
| 6,484,666 | B1 * | 11/2002 | Reusche | 119/69.5 |
| 6,684,813 | B1 | 2/2004 | Lemon | |
| 7,484,671 | B2 * | 2/2009 | Wigglesworth et al. | 239/20 |
| 2003/0075113 | A1 | 4/2003 | Desatoff | |

FOREIGN PATENT DOCUMENTS

| | | |
|---|---|---|
| WO | WO2005/011874 | 2/2005 |

* cited by examiner

*Primary Examiner* — Davis Hwu
(74) *Attorney, Agent, or Firm* — Gifford, Krass, Sprinkle, Anderson & Citkowski, P.C.

(57) ABSTRACT

A birdbath fountain includes a water reservoir and recirculating system. Water for the fountain is pumped from the reservoir, with the excess water from the bowl being returned to the reservoir, thereby allowing for a bowl which remains full or at a consistent depth for a longer period of time, including periods of dry or windy weather conditions. In the preferred configuration, the bowl has a depth defined by an outer raised rim and an inner raised rim. A water-containing reservoir having a depth greater than the depth of the bowl resides within the inner raised rim. An electrically operated submersible pump disposed in the water-containing reservoir is operative to pump water from the reservoir to the fountain head, after which the water returns to the bowl. At least one notch in the inner raised rim provides a fluid path from the bowl back to the reservoir, thereby keeping the water level of the bowl substantially constant.

7 Claims, 3 Drawing Sheets

Assembly : ① → ② → ③ → ④

COMBINATION BIRDBATH FOUNTAIN WITH WATER LEVEL MAINTAINING RESERVOIR

REFERENCE TO RELATED APPLICATION

This application claims priority from U.S. Provisional Patent Application Ser. No. 60/694,370, filed Jun. 27, 2005, the entire content of which is incorporated herein by reference.

FIELD OF THE INVENTION

This invention relates generally to birdbaths and fountains and, in particular, to a combination birdbath fountain including a water level maintaining reservoir.

BACKGROUND OF THE INVENTION

Fountain birdbaths have been developed, including solar-powered fountain birdbaths. However, these utilize a single, relatively shallow water bowl, requiring frequent refilling due to wind and evaporation. Once the water is used up, the fountain stops working, which could lead to damage and overheating.

SUMMARY OF THE INVENTION

This invention improves upon birdbath fountains through the inclusion of a water reservoir and recirculating system. Water for the fountain is pumped from the reservoir, but in contrast to existing designs, the excess water from the bowl is returned to the reservoir, thereby allowing for a bowl which remains full or at a consistent depth for a longer period of time, including periods of dry or windy weather conditions.

The preferred embodiment of the invention comprises a bowl having a depth defined by an outer raised rim and an inner raised rim. A water-containing reservoir having a depth greater than the depth of the bowl resides within the inner raised rim. An electrically operated submersible pump disposed in the water-containing reservoir is operative to pump water from the reservoir to the fountain head, after which the water returns to the bowl. At least one notch in the inner raised rim provides a fluid path from the bowl back to the reservoir, thereby keeping the water level of the bowl substantially constant.

Also in the preferred embodiment, a solar panel provides electrical power to the pump. The panel preferably has an outer periphery sized to the inner raised rim, thereby providing a cover for the water-containing reservoir. To enhance visual appeal, the outer and inner raised rims, and the solar panel, are circular and concentric, with a stand pipe for the fountain head extending through the center of the solar panel. To ease shipping, the bowl and reservoir form part of an upper unit which is assembled on a stand.

DETAILED DESCRIPTION OF THE INVENTION

Figure 1:
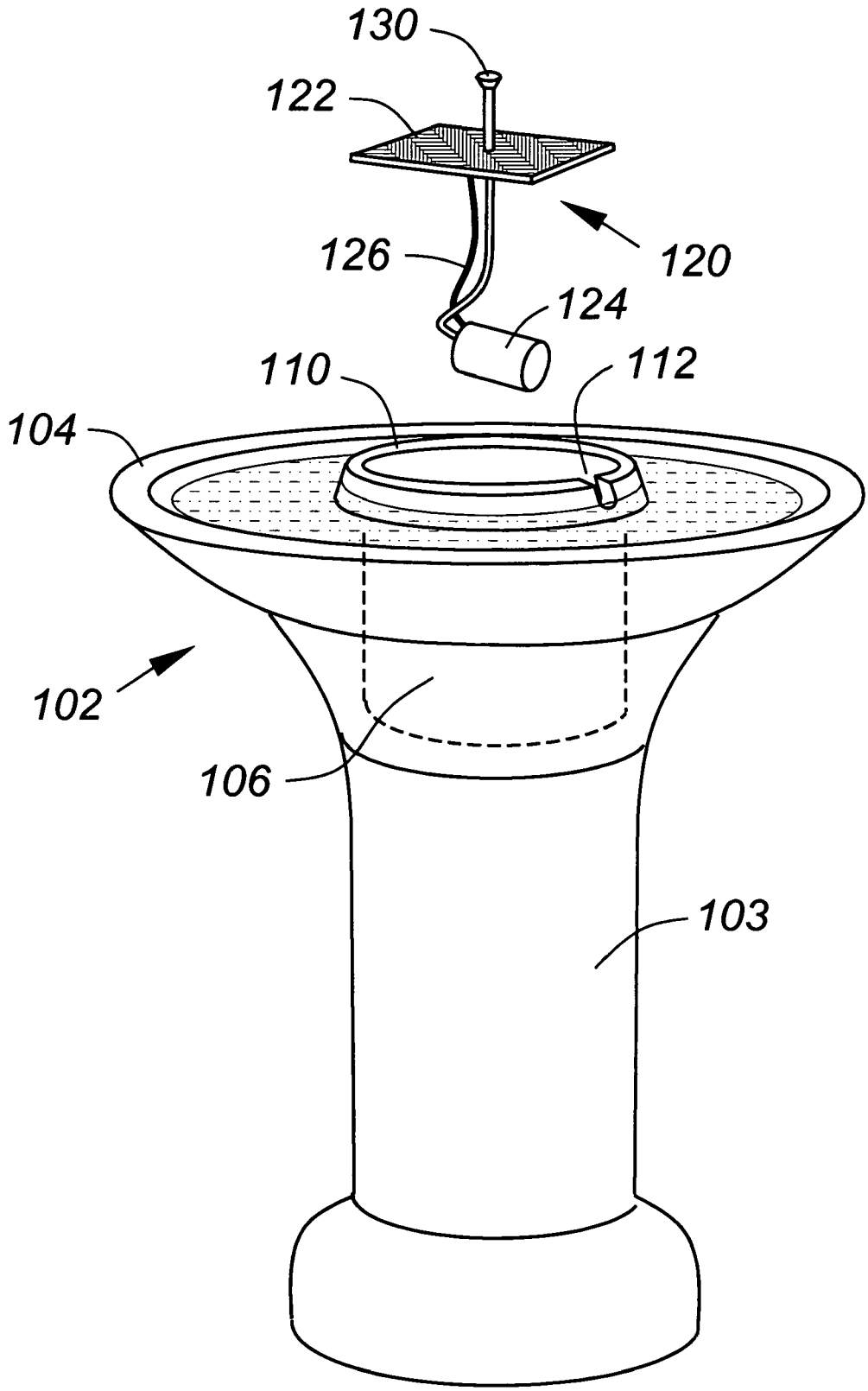
FIG. 1 is a perspective view drawing of the preferred embodiment of the invention.
Figure 3:
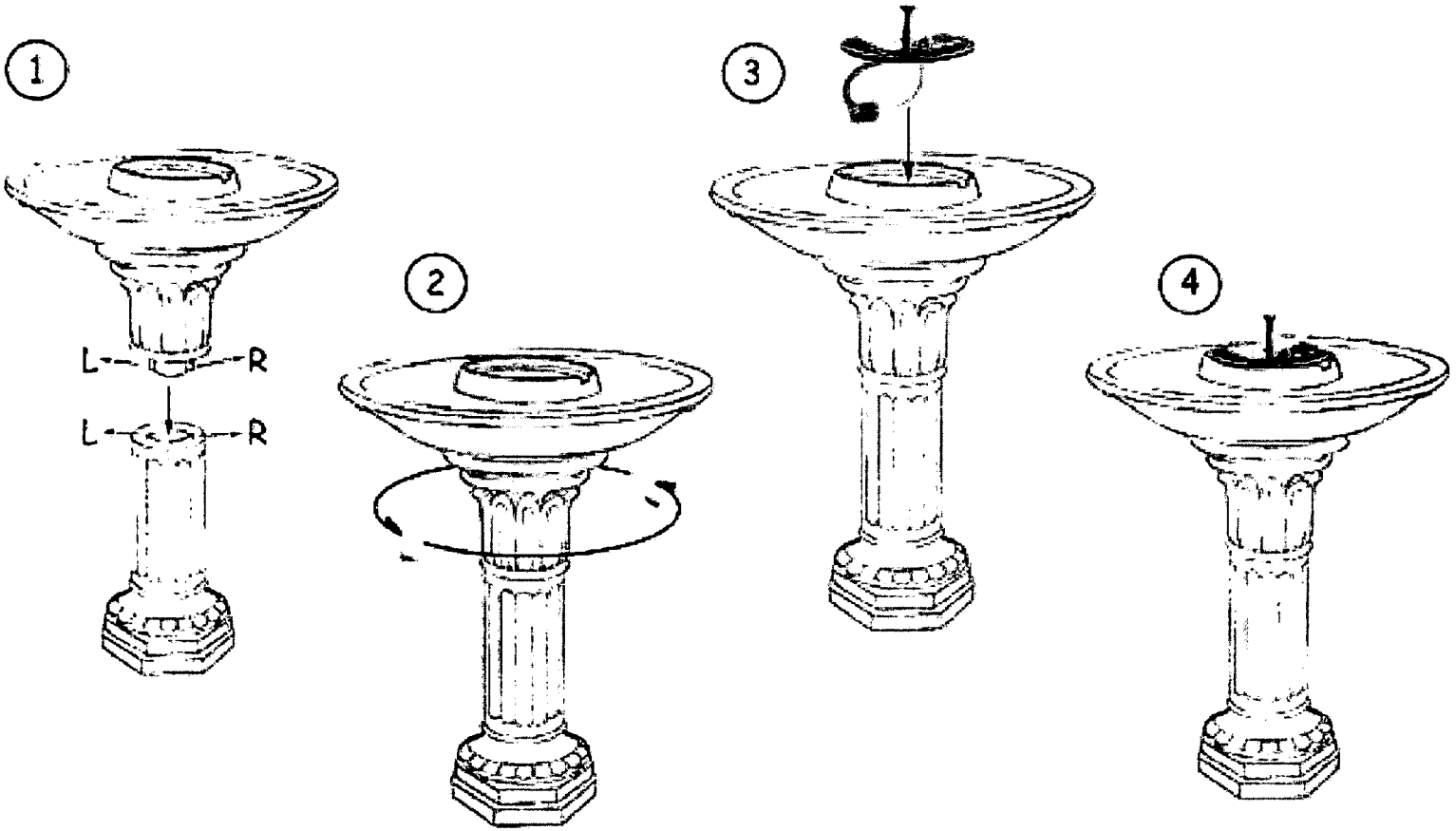
FIG. 3 is a drawing that shows the way in which the preferred embodiment of the invention is assembled.

FIG. 1 illustrates the preferred embodiment of the invention. In terms of structure, the system includes an upper unit 102 having a bowl portion defined by an outer rim 104 and an inner rim 110. Within the inner rim 110 is a separate, deeper water reservoir 106 that holds several liters of water, more or less. The assembly of the system is depicted in FIG. 3. The components are preferably fabricated from ceramic, though plastics or other materials may alternatively be used.

The preferred embodiment utilizes a solar-powered fountain unit 120, including a solar panel 122 and pump 124 which feeds a spray head 130 through a tube. Wires powering the submersible pump 124 are indicated at 126. The unit 120 is placed on a rim 110, such that the pump 124 is located down toward the bottom of the reservoir. But for the pump, tubing and wiring, the remainder of the solar unit 120 is out of the water. Optionally, rechargeable batteries may be provided, allowing for fountain action to continue with reduced solar energy.

Figure 2A:
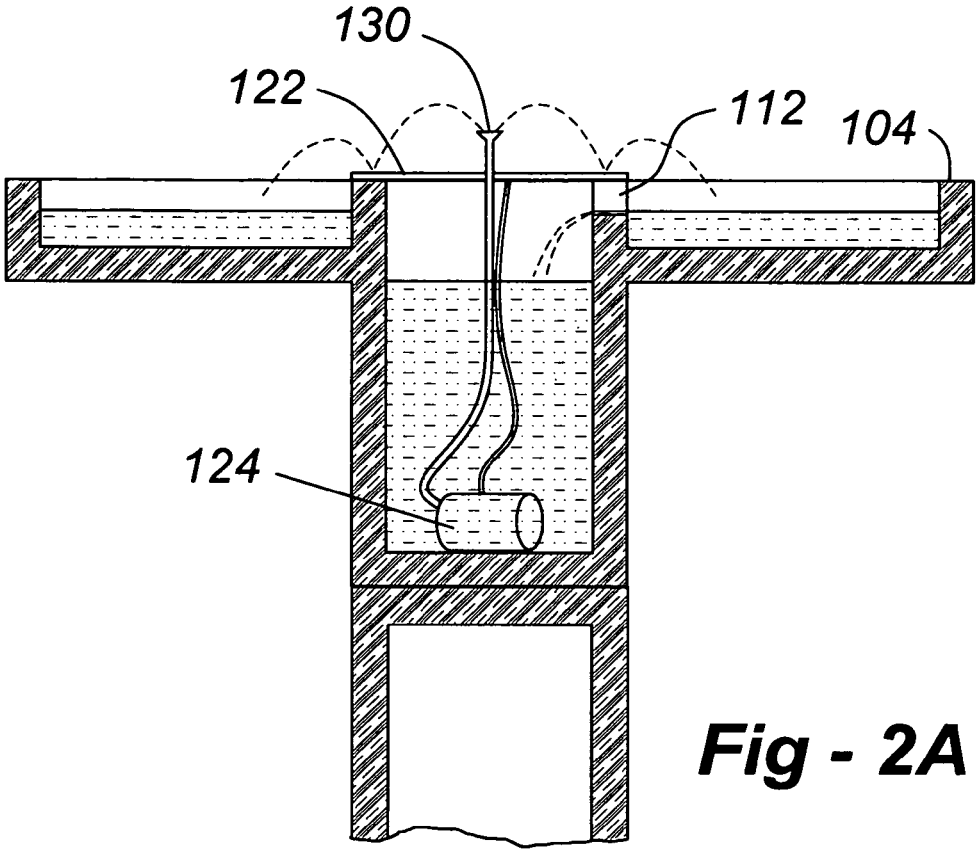
FIG. 2A is a cross-sectional, side-view drawing of the preferred embodiment of FIG. 1.

At least one notch 112 is provided through the inner rim 110 providing a return path for water from the bowl to return to the reservoir to be recirculated. The depth of the notch is partway down from the upper surface of the inner lip 110 to maintain the level in the bowl at a desired, predetermined depth on the order of one to ten centimeters, or thereabouts. As perhaps best seen in FIG. 2A, as water is pumped from the reservoir, it exits through the head 130 from the upper spout of a tube 130 and returns to the bowl 104. Once the bowl reaches an appropriate depth, up to the notch 112, it drains back into the water reservoir, thereby keeping a consistent level in the bowl even as water in the reservoir is used up.

Figure 2B:
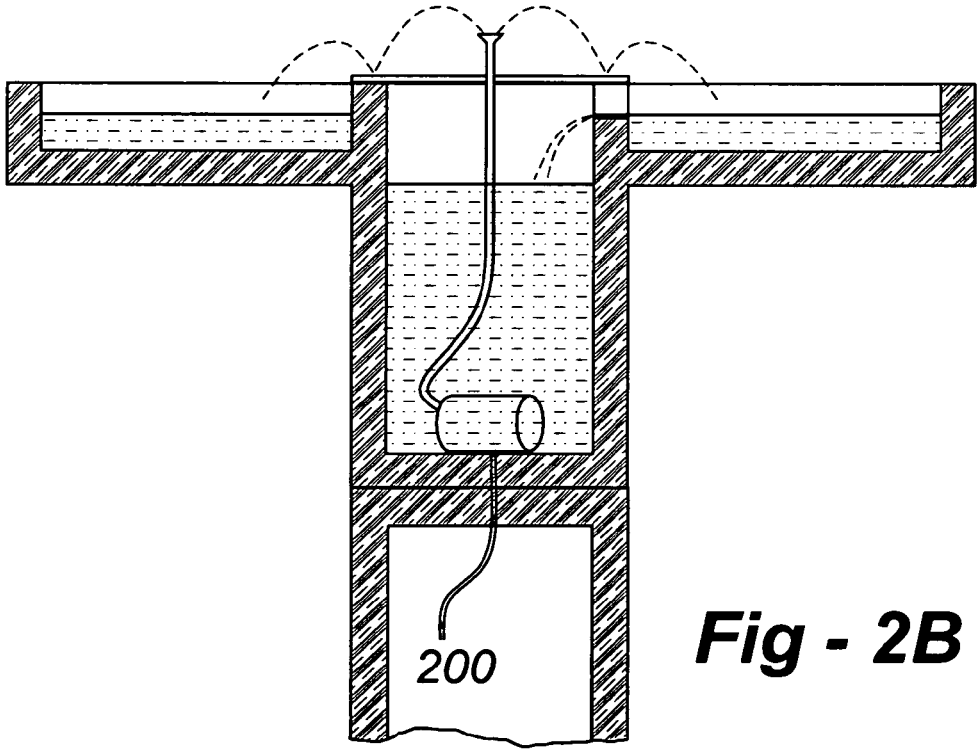
FIG. 2B is a cross-sectional, side-view drawing of an alternative embodiment of the invention using a remote power source as opposed to a solar panel.

As shown in FIG. 2B, the inventive use of a level-maintaining reservoir and notch may be achieved with a direct power line from a remote source, for example, as opposed to the use of a solar panel assembly according to the preferred embodiment. Although the water is shown cascading off of a solar panel 122, the actual water pattern provided by the pump and assembly may vary depending upon environmental conditions.

I claim:

1. A fountain birdbath, comprising:

a bowl;

a water-containing reservoir;

a fountain head;

an electrically operated submersible pump disposed in the water-containing reservoir operative to pump water from the reservoir to the fountain head, after which the water returns to the bowl;

a fluid path from the bowl back to the reservoir, thereby keeping the water level of the bowl substantially constant;

a solar panel providing electrical power to the pump; and wherein:

the dimensions of the solar panel are such that it provides a cover for the water-containing reservoir, the bowl is defined by an outer raised rim and an inner raised rim, the reservoir is disposed within the inner raised rim, and the fluid path is formed by one or more notches in the inner rim, the depth of which define the water level of the bowl.

2. The fountain birdbath of claim 1, wherein the pump delivers water to the fountain head through the solar panel.

3. The fountain birdbath of claim 1, wherein the bowl and reservoir form part of an upper unit resting on a stand.

4. A fountain birdbath, comprising:

a bowl;

a water-containing reservoir;

a fountain head;

an electrically operated submersible pump disposed in the water-containing reservoir operative to pump water from the reservoir to the fountain head, after which the water returns to the bowl;

a fluid path from the bowl back to the reservoir, thereby keeping the water level of the bowl substantially constant;

a solar panel providing electrical power to the pump; and wherein:

the dimensions of the solar panel are such that it provides a cover for the water-containing reservoir, the bowl is defined by an outer, circular raised rim and an inner, concentric raised rim;

the reservoir is disposed within the inner raised rim; and the fluid path is formed by one or more notches in the inner rim, the depth of which define the water level of the bowl.

5. A fountain birdbath, comprising:

a bowl having a depth defined by an outer, circular raised rim and an inner concentric raised rim;

a water-containing reservoir within the inner raised rim having a depth greater than the depth of the bowl;

a fountain head;

a circular solar panel dimensioned to cover the water-containing reservoir;

a submersible pump disposed in the water-containing reservoir and powered by the solar panel, the pump being operative to pump water from the reservoir through the solar panel to the fountain head, after which the water returns to the bowl; and at least one notch having a depth in the inner raised rim, the notch establishing a fluid path from the bowl back to the reservoir, the depth of the notch keeping the water level of the bowl substantially constant.

6. The fountain birdbath of claim 5, wherein the bowl and reservoir form part of an upper unit resting on a stand.

7. The fountain birdbath of claim 5, wherein the pump delivers water to the fountain head through the solar panel.

* * * * *